US005647072A

United States Patent [19]

Shaffer et al.

[11] Patent Number: 5,647,072

[45] Date of Patent: Jul. 15, 1997

[54] FOOT SUPPORT DEVICE FOR SHOWER AREAS

[76] Inventors: Pauline S. Shaffer; Curt A. Shaffer, both of 28 Viking Dr., Englewood, Colo. 80110

[21] Appl. No.: 516,001

[22] Filed: Aug. 16, 1995

[51] Int. Cl.[6] ..... A47K 3/024

[52] U.S. Cl. ..... 4/574.1

[58] Field of Search ..... 4/574.1, 573.1, 4/571.1

[56] References Cited

U.S. PATENT DOCUMENTS

| | | | |
|---|---|---|---|
| 5,228,151 | 7/1993 | Livingston-Capoano | 4/574.1 |
| 5,340,070 | 8/1994 | Soma | 4/574.1 X |

FOREIGN PATENT DOCUMENTS

| | | | |
|---|---|---|---|
| 2405599 | 8/1975 | Germany | 4/574.1 |

OTHER PUBLICATIONS

Copy of "Shower Shelf" product, manufactured by Selfix, Inc., 4501 W. 47th Street, Chicago, IL 60632.

Copy of "Fogless beauty mirror keeps razors, sponges & lotions handy and organized" brochure, manufactured by Selfix, Inc., 4501 W. 47th Street, Chicago, IL 60632.

Copy of "Shaver's Ledge" brochure (inventor Leslie Stevens, Denver, Colorado).

*Primary Examiner*—Charles E. Phillips

*Attorney, Agent, or Firm*—Timothy J. Martin; Michael R. Henson

[57] ABSTRACT

A foot support device is adapted to mount in a corner formed by the walls of a shower area in order to support the foot and leg of a bather for washing or shaving the leg. The foot support device includes a shelf panel that is supported approximately twenty to sixty centimeters above the shower base and is preferably oriented at an oblique angle of between 15° and 30° to the base. A mounting structure mounts the shelf panel to the walls and includes a pair of mounting panels that confront the walls. Preferably, the shelf panel and the mounting panel are formed as a crescent-shaped, integral piece of molded plastic, and the mounting panels are hinged along linear regions of reduced thickness that define lateral side edges for the shelf panel. Drain openings are formed through the shelf panel, and reinforcing ribs extend around these openings. Reinforcing lips extend along the front and rear edges of the shelf panel and also provide limit stops to help position the mounting panels. The mounting panels are provided with adhesive strips to adhere the foot support device to the shower walls. Alternatively, the foot support device may be formed as interlocking cantilevered panels.

25 Claims, 4 Drawing Sheets

FOOT SUPPORT DEVICE FOR SHOWER AREAS

FIELD OF THE INVENTION

The present invention broadly concerns bath accessories which may be employed by a bather. More particularly, however, the present invention concerns foot supports which may provide an elevated rest above the base of a shower area whereby a bather may rest the foot while shaving the leg.

BACKGROUND OF THE INVENTION

Different cultures have developed a variety of customs regarding the aesthetic presentation of the human body. One attribute of the body which has received great attention, of course, is hair, whether it be scalp hair, facial hair or other body hair. In many Western cultures, for example, it is common, especially for women, to remove body hair from different parts of the body, most notably the underarms and legs. While various chemical and electrical processes have been developed for the removal of bodily hair, such removal is most commonly accomplished by shaving.

Where a person desires to shave the legs, this practice most often occurs while bathing, either in a submersion bath or during a shower event. In either event, care must be taken while shaving the legs in order to avoid cuts or other damage to the skin where a bladed razor is employed. Further, where the shaving of the legs occurs in a shower stall, it is difficult and awkward for a person to stoop over to gain access to the lower parts of the leg. Standing on one foot while attempting to elevate the leg, without proper balance, can create a hazardous situation wherein the person may slip or fall and thus injure the body. This is also a problem where the leg is being washed as opposed to being shaved.

While some shower areas, such as bathtubs, have horizontal ledges extending around the periphery so that a person may rest his/her foot on the ledge while shaving or washing the leg, many shower enclosures do not have convenient rests in accessible positions. Where soap dishes or other shelves are provided, these are typically out of reach for resting the foot and, moreover, are not designed as a foot rest to support the foot or the leg. In any event, horizontal surfaces tend to collect the water, soap, hair and other materials should they be used as a foot rest during shaving or washing of the leg such that an unsightly and possibly unsanitary condition may result.

Accordingly, there has been a long felt need for a bath accessory which can be used to assist a person when shaving and/or washing his/her leg. There is a further need for a device which will reduce the need for stooping or bending over in a shower area in order to have access to the lower portions of the leg in order to shave or wash the same. There is accordingly a need for a foot support device that may be used in shower areas in order to elevate the foot in a convenient and safe manner while avoiding unsightly and unsanitary conditions. There is a further need for such a device that may retrofit into existing shower areas.

SUMMARY OF THE INVENTION

It is an object of the present invention to provide a new and useful foot support device which may be mounted in a shower area in order to support the foot in a convenient elevated position to increase the ease for a person when shaving and/or washing his/her legs.

Another object of the present invention is to provide an inexpensive foot support device which may retrofit into existing shower areas.

Another object of the present invention is to provide a foot support device which requires no assembly and which is easily mounted on the sidewalls of the shower.

Still a further object of the present invention is to provide a foot support device which, when mounted, is not obtrusive into the shower area.

Still another object of the present invention is to provide a foot support device for use in shower areas which is pleasing in appearance, safe and sanitary during use.

According to the present invention, then, a foot support device is adapted to mount in a corner of shower area wherein the shower area is formed by a base upon which a bather stands during a shower event and by at least two upright walls that are oriented at a corner angle with respect to one another thereby to form a corner for the shower area. The foot support device is operative to support the foot, and therefore the leg, of the bather such that the foot is elevated relative to the base of the shower thereby to facilitate shaving and/or washing of the leg.

Broadly, this invention includes a shelf-like ledge which defines a surface on which the foot may be placed and a mounting structure connected to the ledge. The mounting structure includes a pair of mounting panels oriented at the corner angle with respect to one another such that the mounting panels are respectively positionable against the upright walls of the shower. Fasteners are operative to secure the mounting panels respectively to the upright walls so that the ledge is supported in the mounted state. The ledge is, moreover, secured to the mounting panels in such a manner that it is disposed at an oblique angle, preferably about 10°–30° with respect to the shower base when in the mounted state. The ledge may be provided with a textured or non-slip upper surface.

Preferably, the ledge is provided with a plurality of drain openings therethrough with these drain openings being formed as elongated slots which extend forwardly of the corner when the ledge is in the mounted state. Reinforcing ribs extend around each of the drain openings to rigidify the ledge. Further, it is preferred that the ledge have a rear edge facing the corner when the ledge is in the mounted state and a front edge opposite the rear edge. These edges include first and second reinforcing lips to further rigidify the ledge. The rear edge and front edge may be formed along radii of curvature. In this manner, an opening is formed between the rear edge and the corner formed by the sidewalls of the shower area.

Preferably, the ledge and the mounting panels are formed as an integral piece of plastic material, such as polypropylene, with the mounting panels being hinged relative to the ledge. This can be accomplished by hinging the mounting panels directly to the ledge or to other parts of the mounting structure. Moreover, the ledge is preferably crescent shaped in configuration and has hinge lines formed by linear areas of reduced thickness. Here, the reinforcing lips also provide registration stops which help orient the mounting panels when they are pivoted into an orientation for mounting into the corner area of the shower. Adhesive layers may be provided on the mounting panels as the fasteners so that the mounting panels may be affixed to the sidewalls of the shower.

An alterative embodiment, the support structure includes a back panel extending downwardly from the rear edge, and a front panel extends downwardly from the front edge. The front and back panels are hingedly secured to the ledge such that distal portions of the front and back panels may be placed in contact with one another. Here, locking elements are provided to secure the distal portions of the front and back panels together so that the front panel forms cantilever support for the ledge. The locking elements may include locking slots in one of the front and back panels and mating pads in another of the front and back panels. Here, also, the mounting panels are hingedly secured to the lateral side edges of the back panel. These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

Figure 1:
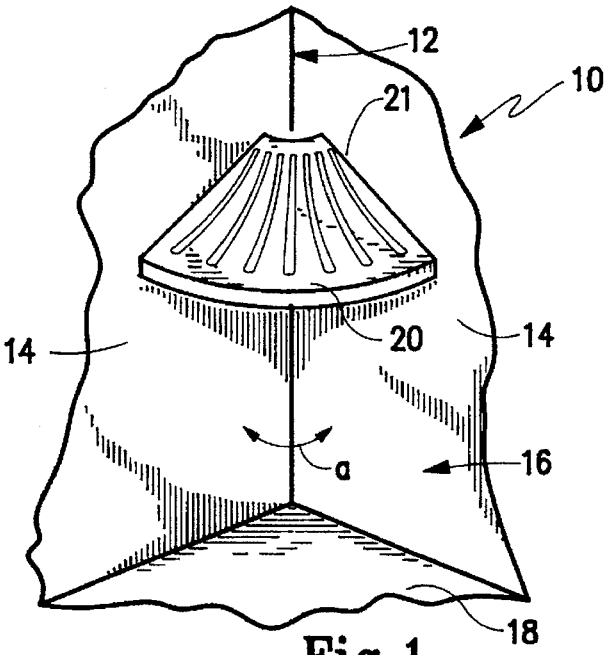
FIG. 1 is a perspective view of a first exemplary embodiment of the foot support device according to the present invention shown in a folded and mounted state.

The present invention concerns a foot support device that is adapted to mount in a corner of a shower area so that a person may support his/her foot thereon in order to position a leg for shaving hair therefrom or for washing the leg. Thus, the foot support device of the present invention is operative to elevate the foot a convenient distance from a base upon which the bather stands during a shower event, and this distance is selected to be between twenty and sixty centimeters above the base on which the bather stands, such height being found suitable for the majority of persons of ordinary height. The present invention thus is directed to improvements in shower areas by providing those shower areas with such a support surface.

A first exemplary embodiment of the present invention is shown in FIGS. 1–10. First, with reference to FIG. 1, it may be seen that foot support device 10 is in a mounted state wherein it is mounted in a corner 12 formed by a pair of upright walls 14 that are oriented at a corner angle "a" with respect to one another in a shower area 16. Shower areas 16 is provided with a horizontal base 18 upon which a bather or other stands, and upright walls 14 extend generally vertically upwardly of base 18. Typically, the corner angle "a" is 90°, although other corner angles are not unusual for such shower areas 16.

Figure 2:
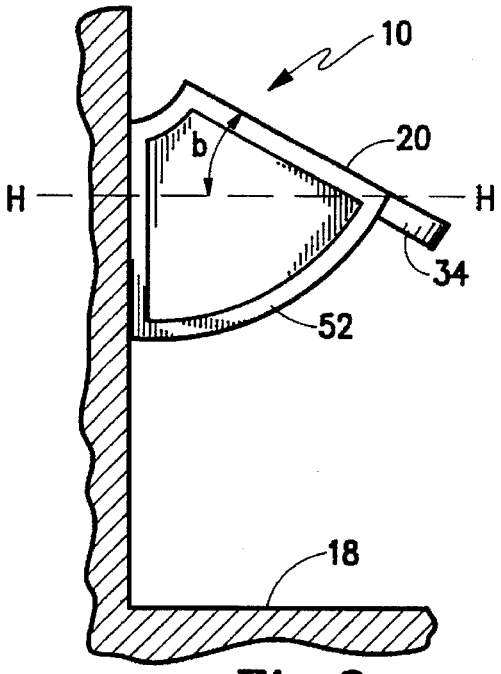
FIG. 2 is a side view in elevation of the foot support device shown in FIG. 1.
Figure 3:
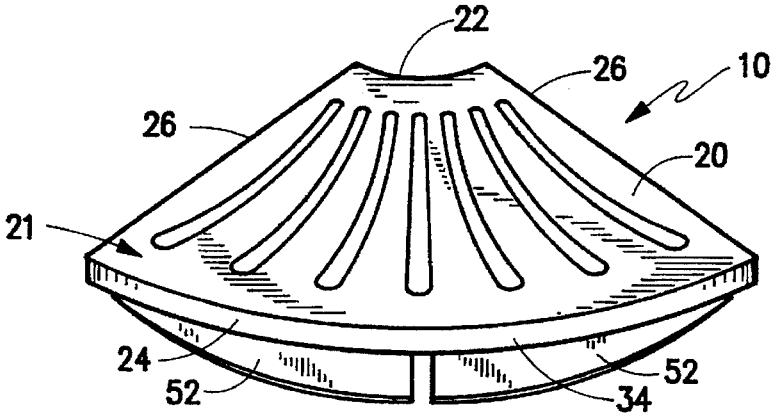
FIG. 3 is a front view in elevation of the foot support device shown in FIG. 2 in the folded condition but unmounted.
Figure 4:
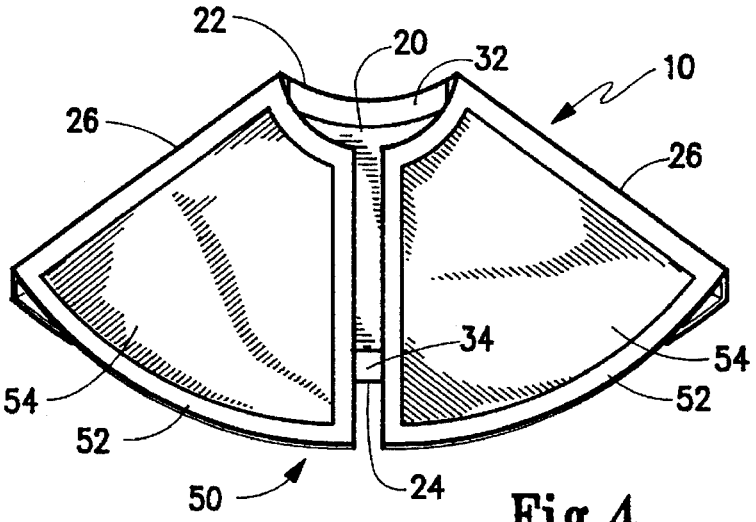
FIG. 4 is a rear view in elevation of the foot support device shown in FIGS. 2 and 3 in the folded condition.
Figure 8:
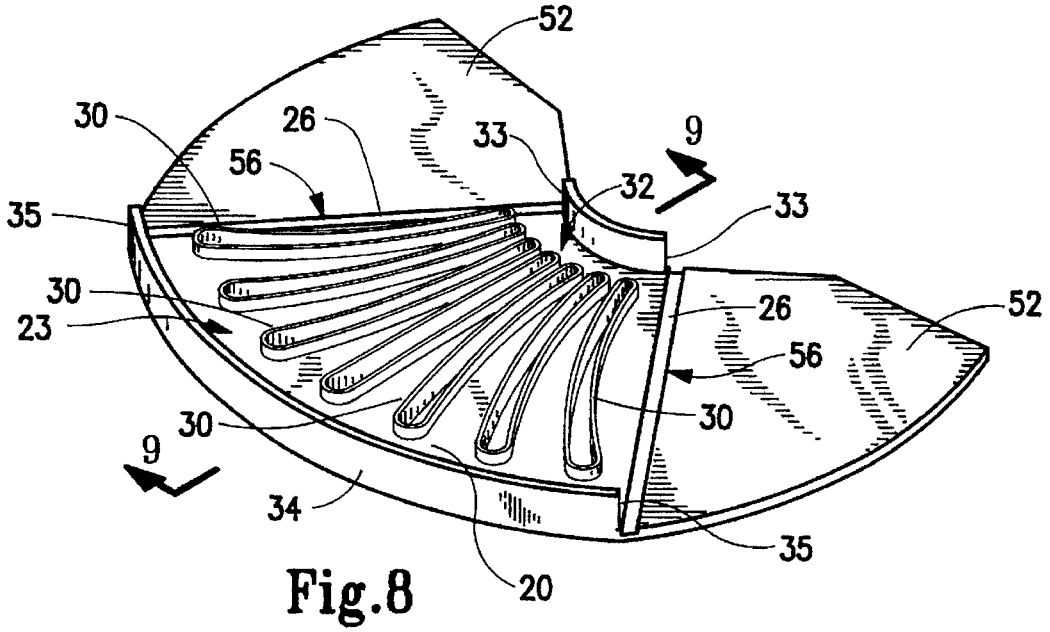
FIG. 8 is a perspective view of the foot support device shown in FIGS. 1–7 in the unfolded condition and showing the bottom thereof.
Figure 9:
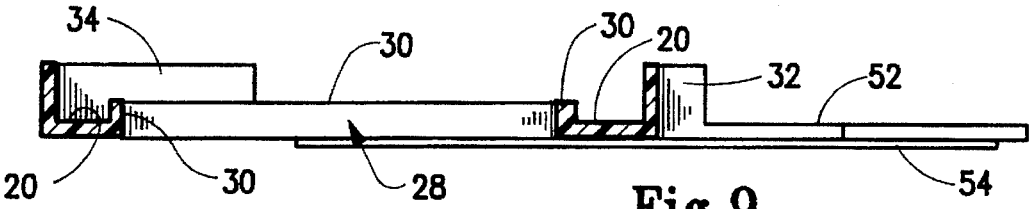
FIG. 9 is a cross-sectional view taken about lines 9—9 of FIG. 8.
Figure 10:
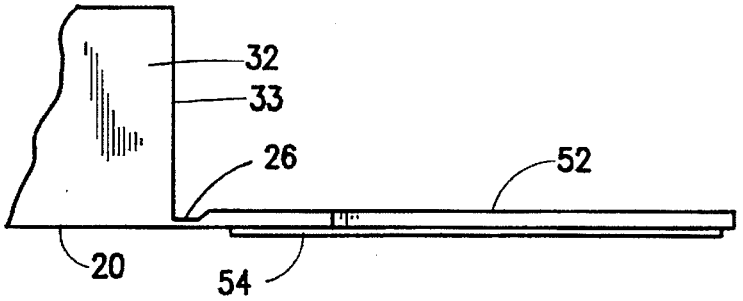
FIG. 10 is an enlarged partial side view in elevation showing the mounting panel structure for the foot support device of FIGS. 1–9 in an unfolded condition.
Figure 5:
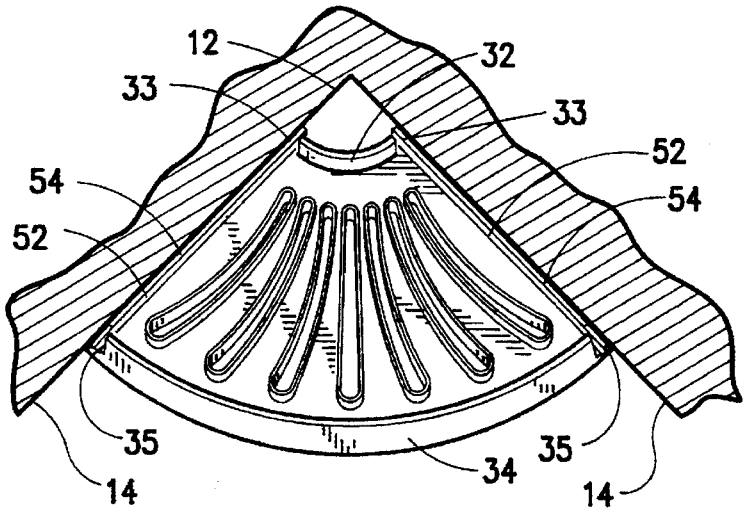
FIG. 5 is, a bottom plan view of the foot support device shown in FIGS. 1–4 in the folded condition and in the mounted state, such as shown in FIG. 1.
Figure 6:
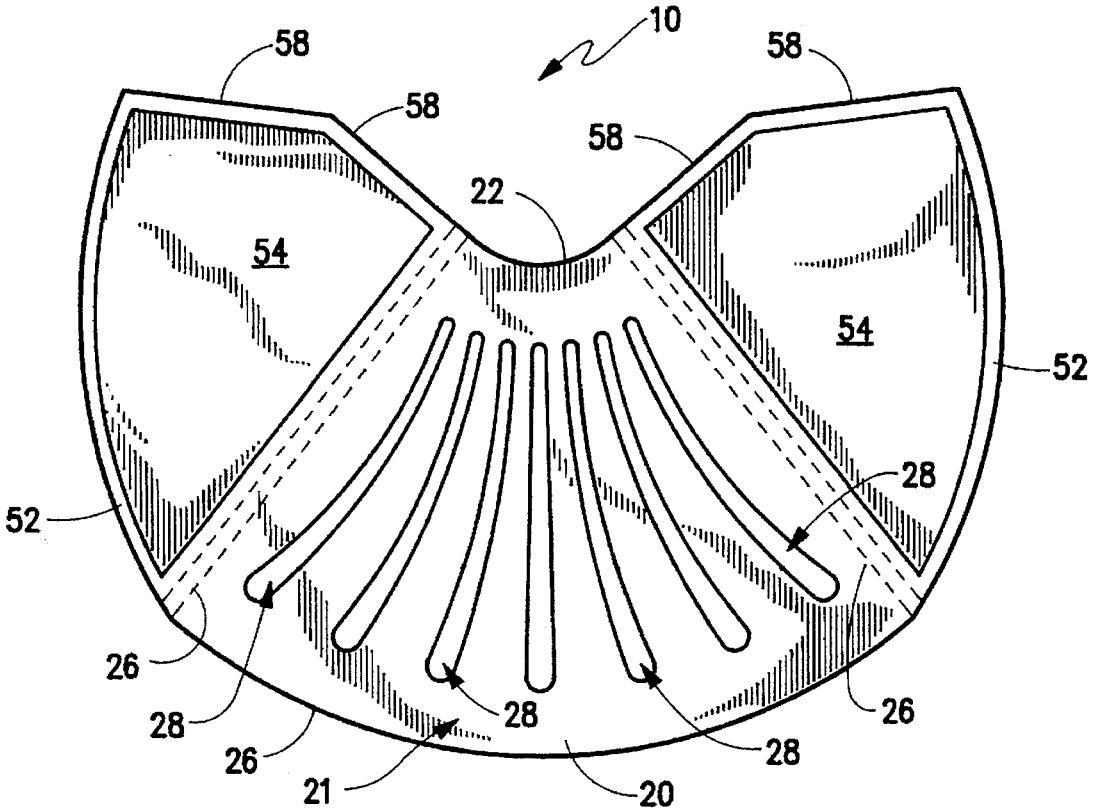
FIG. 6 is a top plan view of the foot support device shown in FIGS. 1–5 in an unfolded condition.
Figure 7:
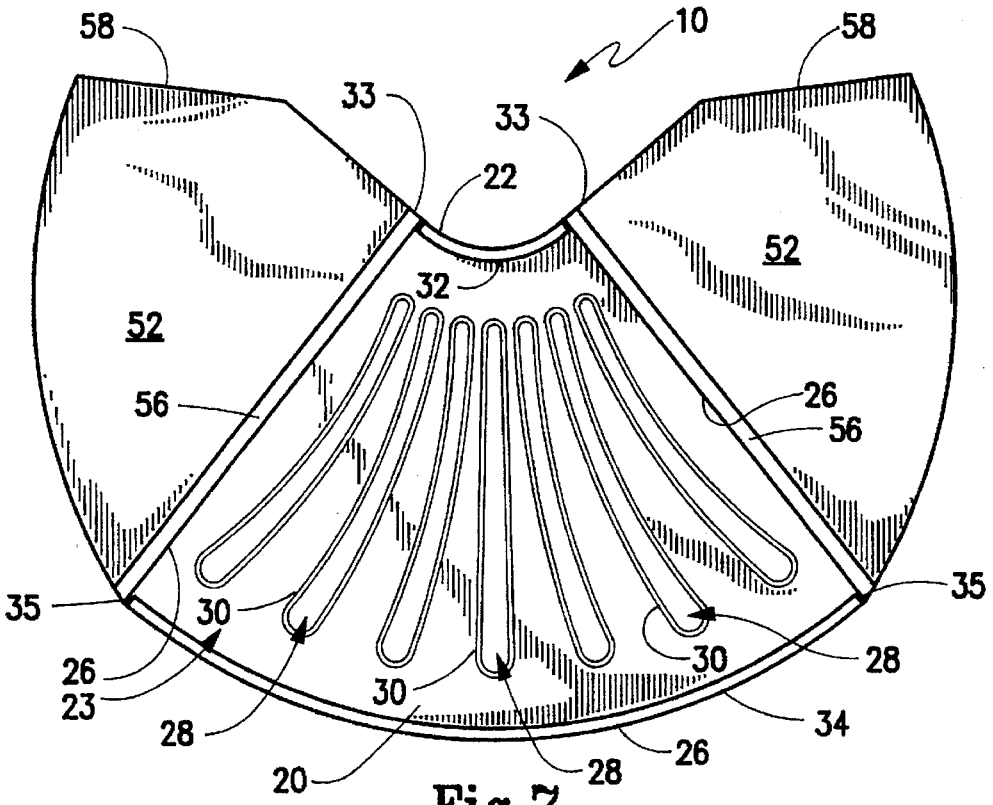
FIG. 7 is a bottom plan view of the foot support device shown in FIGS. 1–6 in the unfolded condition.

Foot support device 10 is best shown folded and in the mounted state in FIGS. 1 and 2. Foot support device 10 is best shown in an unmounted state, but in folded condition, in FIGS. 3–5 and in an unmounted and unfolded condition in FIGS. 6–10. With reference to these figures, then, it may be seen that foot support device 10 includes a shelf panel 20 that has an arcuate rear edge 22, an arcuate front edge 24 and a pair of lateral side edges 26. Shelf panel 20 is provided with a mounting structure 50 with mounting structure 50 including a pair of mounting panels 52 which are respectively positionable against the upright walls 14 so as to have an upper surface 21 and an undersurface 23. Surface 21 may be textured, as is shown in these figures, or provided with a non-slip material to increase stability of the foot thereon. As is shown in FIGS. 2–5, panels 52 are oriented at the corner angle "a" with respect to one another so that they may confront the upright walls 14 of shower area 12, as is shown in FIGS. 1 and 5. Moreover, mounting panels 52 are oriented so that, when shelf panel 20 is in the mounted state, such as shown in FIGS. 1 and 5, shelf panel 20 is disposed at an oblique angle "b" with respect to horizontal base 18 as shown in reference to horizontal plane "H". Oblique angle "b" is in the range of 10° to 30° and is preferably about 15°.

To accomplish the mounting of foot support device 10, fasteners, such as adhesive layers 54, are disposed on mounting panels 52. Preferably, fasteners or layers 54 are formed by double sided tape of suitable strength to securely affix a foot support device 10 in corner 12 of shower area 16. Of course, it should be understood that other fasteners, for example suction cups, screws or other mechanical fasteners, could be used either to releasably or permanently secure foot support device 10 to the walls 14.

With reference now to FIGS. 6–10, it may be seen that foot support device 10 is formed as an integral piece of molded plastic material that is crescent-shaped in configuration. Accordingly, shelf panel 20 and mounting panels 52 are integral with respect to one another. Shelf panel 20 and mounting panels 52 are approximately one-eighth inch thick (0.3 cm). In these figures, it may be seen that each of mounting panels 52 is hingedly joined along a lateral side edge 26 of shelf panel 20 by means of a linear region 56 having a reduced thickness. Shelf panel 20 is provided with a plurality of elongated, slot-like drain openings 28. To strengthen and rigidify shelf panel 20, however, reinforcing ribs 30 extend around each of drain openings 28 on the undersurface 21 of shelf panel 20. When mounted, as shown in reference to FIG. 1, each of the drain openings 28 extend forwardly of corner 12. In order to further strengthen shelf panel 20, an arcuate reinforcing lip 32 extends along and projects from rear edge 22 on a common side thereof as ribs 30. Further, an arcuate reinforcing lip 34 extends along and projects from front edge 24. Lips 32 and 34 are approximately ¾ inch (2.0 cm) in height.

As noted above, foot support device 10 is shown in an unfolded state in FIGS. 6–10. This allows for ease of manufacturer and packaging. However, for installation, mounting panels 52 may be pivoted along regions 56 which form hinges, so that foot support device 10 may be positioned in a folded condition wherein mounting panels 52 are generally perpendicular to shelf panel 20. In such folded condition, as is shown in FIG. 5, mounting panels 52 are oriented with respect to one another at the corner angle "a" so that they may respectively confront upright walls 14 with layers 54 fastening foot support device 10 to the upright wall 14 in the shower area 16. To facilitate the orientation into the folded state, it may be seen that arcuate lips 32 and 34 are sized and positioned to provide limit stops for the movement of mounting panels 52 so that the mounting panels 52 may be oriented at corner angle "a". Here, also, it should be appreciated that lateral side edges 26 are oriented at an angle that is less than the corner angle "a" so that, when mounted, shelf panel 20 will be at the oblique angle "b". Where corner angle "a" is 90°, the angle between lateral side edges 26 should be about 70° to 80° converge towards one another in a direction from front edge 24 toward rear edge 22. When mounting panels 52 are pivoted into the folding state, they will abut the opposed edges 33 of arcuate lip 32 and the opposed edges 35 of arcuate lip 34.

In order to mount foot support device 10, then, it may now be readily appreciated that the user first pivots each of mounting panels 52 so that they respectively abut the opposed edges 33 and 35 of lips 32 and 34. In this position, rear edges 58 of mounting panels 52 will be parallel to one another as is shown in FIG. 4. Mounting panels 52 will now be oriented with respect to one another at the corner angle "a", and the user may select the desired height for shelf panel 20 and attach foot support device 10 to walls 14 by means of adhesive layers 54. The person's foot may now be conveniently positioned on shelf panel 20 which inclines upwardly toward corner 12 and that convenient angle of the foot when the leg is raised in an elevated position. Moreover, this oblique angle of shelf panel 20 allows water to drain off of the foot support device 10. Moreover, water may drain off of shelf panel 20 through drain openings 30. This helps to keep foot support device 10 free of slippery and unsightly soap scum or other debris. Moreover, the oblique angle reduces the likelihood that someone will inadvertently use the foot support device 10 as a step upon which to stand.

Figure 11:
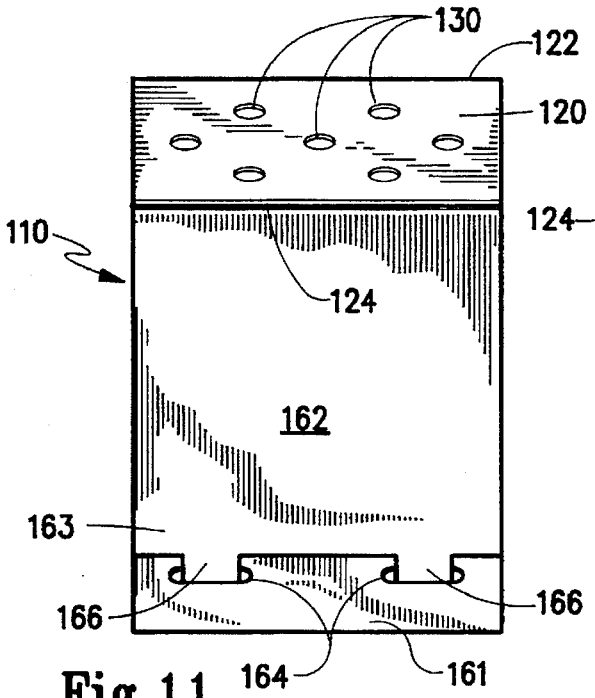
FIG. 11 is a front view in elevation of a second exemplary-embodiment of a foot support device according to the present invention.
Figure 12:
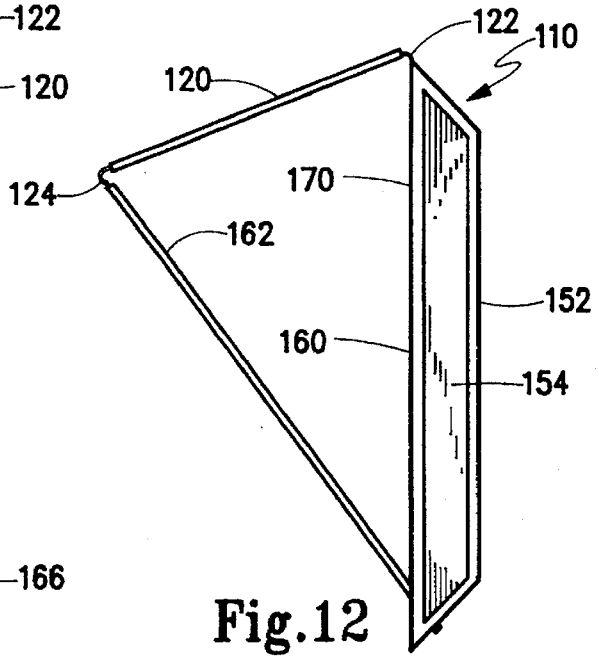
FIG. 12 is a side view in elevation of the foot support device shown in FIG. 11.
Figure 13:
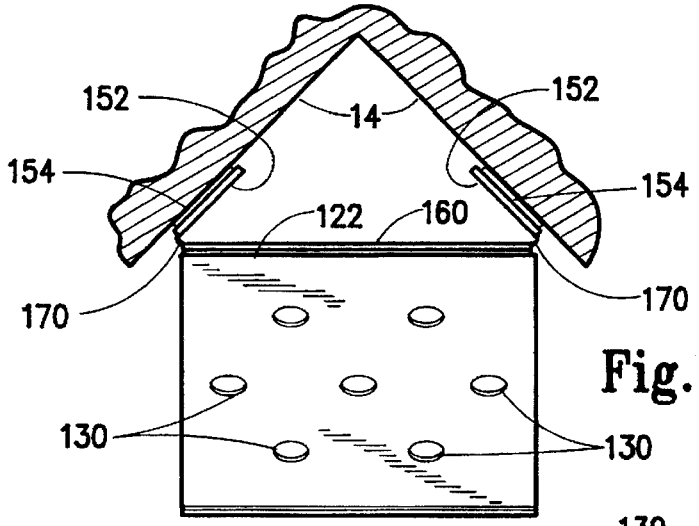
FIG. 13 is a top plan view of the foot support device shown in FIGS. 11 and 12 in a mounted state.

An alternative embodiment of the present invention is shown in FIGS. 11–14. Here, it may be seen that foot support device 110 has a shelf panel 120 provided with a plurality of circular drain openings 130 therein. A back panel 160 is pivotally mounted to a rear edge 122 of shelf panel 120, and a front panel 162 is hingedly secured to a front edge 124 of shelf panel 120. This configuration, distal portions 161 and 163, respectively, of front and rear panels 160, 162 may be placed in contact with one another. Locking elements, in the form of locking slots 164 are provided on distal portion 161 of rear panel 160 with corresponding mating tabs 166 being located on distal portion 163 of front panel 162. As is shown in FIGS. 11 and 12, tabs 166 may be positioned in slots 164 so that distal portions 161, 163 of front and rear panels 160, 162 are secured to one another. In this manner, front panel 162 supports shelf panel 120 in a cantilever manner, as is shown in FIG. 12. A pair of mounting panels 152 are hingedly secured to lateral side edges 170 of back panel 160, and mounting panels 152 are provided with fastening elements in the form of adhesive strips 154 for attachment to walls 14 of the shower area.

Figure 14:
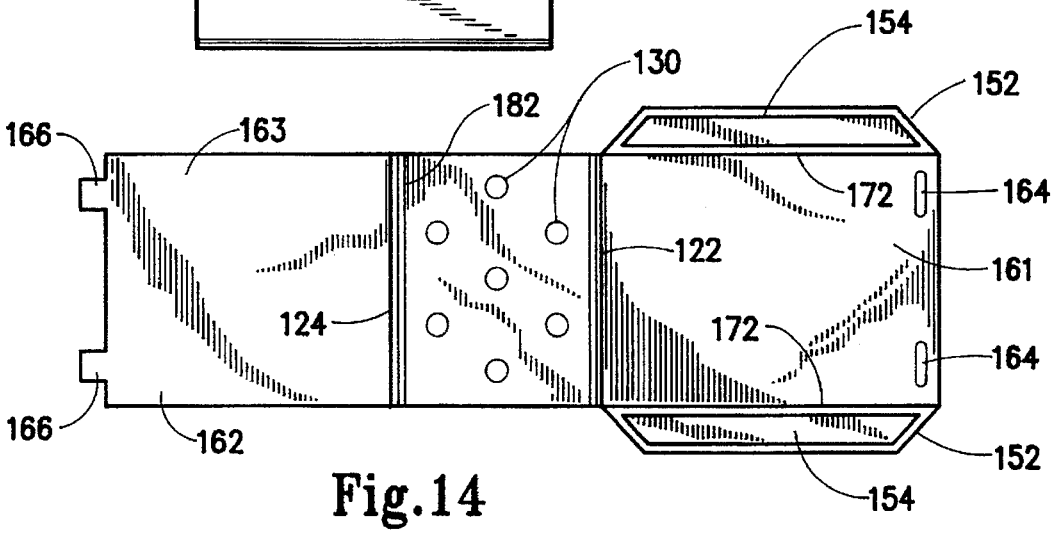
FIG. 14 is a top plan view of the foot support device of FIGS. 11–13 shown in an unfolded condition.

With reference to FIG. 14, it may be seen that foot support device 110 is again preferably formed as an integral piece of plastic with the hinged connection of front panel 162 to shelf panel 120 and the hinged connection of back panel 160 to shelf panel 20 being accomplished by linear regions of reduced thickness 180, 182, respectively. Similarly, the hinged connecting of mounting panels 152 along lateral side edges 170 is accomplished by linear regions of reduced thickness 172. In this manner, foot support device 110 may be folded and secured in a folded state, and then attached in the shower area with shelf panel 120 again oriented at an oblique angle with respect to the shower base.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiments of the present invention without departing from the inventive concepts contained herein.

We claim:

1. A foot support device adapted to mount in a corner of a shower area that is formed by a base upon which a bather stands during a shower event and by at least two upright walls that are oriented at a corner angle with respect to one another thereby to form a corner for the shower area, said foot support operative to support a foot and leg of the bather such that the foot is elevated relative to said base to facilitate shaving of the leg, comprising:

(a) a shelf panel defining a surface on which the foot may be placed;

(b) a mounting structure connected to said shelf panel, said mounting structure including a pair of mounting panels oriented at the corner angle with respect to one another such that said mounting panels are respectively positionable against said upright walls with said shelf panel disposed at an oblique angle with respect to said base, said mounting panels and said shelf panel formed as an integral piece of plastic material, said mounting panels each being hinged relative to said shelf panel; and (c) fasteners operative to secure said mounting panels respectively to said upright walls so that said shelf panel is supported in a mounted state on said upright walls as a shelf-like ledge.

2. A foot support device according to claim 1 wherein said shelf panel is provided with a plurality of drain openings therethrough.

3. A foot support device according to claim 2 wherein said shelf panel includes re-enforcing ribs extending around each of the drain openings.

4. A foot support device according to claim 3 wherein each of the drain openings is formed as an elongated slot extending forwardly of said corner when said ledge is in the mounted state.

5. A foot support device according to claim 1 wherein said shelf panel has a rear edge facing said corner when in the mounted state and a front edge opposite said rear edge, said shelf panel including a first re-enforcing lip extending along and projecting from said front edge.

6. A foot support device according to claim 5 including a second re-enforcing lip extending along and projecting from said rear edge.

7. A foot support device according to claim 6 wherein said mounting panels are hingedly connected along lateral side edges of said shelf panel, said first and second lips sized and positioned to provide limit stops for movement of said mounting panels such that said mounting panels abut said lips when oriented at the corner angle.

8. A foot support device according to claim 1 wherein said shelf panel has a rear edge facing said corner when in the mounted state and a front edge opposite said rear edge, said mounting structure further including a back panel extending from the rear edge and a front panel extending from the front edge, said front and back panels hingedly secured to said shelf panel such that distal portions of said front and back panels may be placed in contact with one another and including locking elements to secure said distal portions together whereby said front panel forms a cantilever support for said shelf panel.

9. A foot support device according to claim 8 wherein said locking elements include locking slots in one of said front and back panels and mating tabs in another of said front and back panels.

10. A foot support device according to claim 8 wherein said mounting panels are hingedly secured to lateral side edges of said back panel.

11. A foot support device according to claim 1 wherein said shelf panel and said integral piece of plastic is crescent-shaped in configuration.

12. A foot support device according to claim 1 wherein said mounting panels are hingedly secured to said shelf panel along linear regions of reduced thickness defining lateral side edges for said shelf panel.

13. A foot support device according to claim 1 wherein said fasteners include adhesive layers on said mounting panels.

14. A foot support device adapted to mount in a corner of a shower area that is formed by a base upon which a bather stands during a shower event and by at least two upright walls that are oriented at a corner angle with respect to one another thereby to form a corner for the shower area, said foot support operative to support a foot and leg of the bather such that the foot is elevated relative to said base to facilitate shaving of the leg, comprising:

(a) a shelf panel having front and rear edges and a pair of lateral side edges extending therebetween, said side edges oriented at an acute angle with respect to one another such that said side edges converge in a direction from the front edge toward the rear edge, said front and rear edges being arcuate in configuration;

(b) a pair of mounting panels connected to said shelf panel with each said mounting panel extending from a respective one of the side edges thereof, said mounting panels being respectively positionable against said upright walls with said shelf panel disposed at a oblique angle with respect to said base; and (c) fasteners operative to secure said mounting panels respectively to said upright walls so that said ledge is supported in a mounted state on said upright walls.

15. A foot support device according to claim 14 wherein said shelf panel .is provided with a plurality of drain openings therethrough and including ribs extending around each of the drain openings.

16. A foot support device according to claim 14 wherein said shelf panel and said mounting panels are formed as an integral piece of plastic material with said mounting panels being hinged relative to said shelf panel along linear regions of reduced thickness.

17. A foot support device according to claim 16 including a front lip extending along and projecting from said front edge and rear lip extending along and projecting from said rear edge.

18. A foot support device according to claim 17 wherein said front and rear lips are configured to form limit stops such that said mounting panels may be pivoted to abut opposite ends of said front and rear lips and thereby be oriented at the corner angle.

19. A foot support device according to claim 14 wherein said fasteners include adhesive layers on said mounting panels.

20. A foot support device adapted to mount in a corner of a shower area that is formed by a base upon which a bather stands during a shower event and by at least two upright walls that are oriented at a corner angle with respect to one another thereby to form a corner for the shower area, said foot support operative to support a foot and leg of the bather such that the foot is elevated relative to said base to facilitate shaving of the leg, comprising:

(a) a shelf panel defining a surface on which the foot may be placed, said shelf panel having a rear edge facing said corner when in the mounted state and a front edge opposite said rear edge, said shelf panel including a first re-enforcing lip extending along and projecting from said front edge;

(b) a mounting structure connected to said shelf panel, said mounting structure including a pair of mounting panels oriented at the corner angle with respect to one another such that said mounting panels are respectively positionable against said upright walls with said shelf panel disposed at an oblique angle with respect to said base; and (c) fasteners operative to secure said mounting panels respectively to said upright walls so that said shelf panel is supported in a mounted state on said upright walls as a shelf-like ledge.

21. A foot support device according to claim 20 including a second re-enforcing lip extending along and projecting from said rear edge.

22. A foot support device according to claim 21 wherein said mounting panels are hingedly connected along lateral side edges of said shelf panel, said first and second lips sized and positioned to provide limit stops for movement of said mounting panels such that said mounting panels abut said lips when oriented at the corner angle.

23. A foot support device adapted to mount in a corner of a shower area that is formed by a base upon which a bather stands during a shower event and by at least two upright walls that are oriented at a corner angle with respect to one another thereby to form a corner for the shower area, said foot support operative to support a foot and leg of the bather such that the foot is elevated relative to said base to facilitate shaving of the leg, comprising:

(a) a shelf panel defining a surface on which the foot may be placed, said shelf panel having a rear edge facing said corner when in the mounted state and a front edge opposite said rear edge;

(b) a mounting structure connected to said shelf panel, said mounting structure including a pair of mounting panels oriented at the corner angle with respect to one another such that said mounting panels are respectively positionable against said upright walls with said shelf panel disposed at an oblique angle with respect to said base and including a back panel extending from the rear edge and a front panel extending from the front edge, said front and back panels hingedly secured to said shelf panel such that distal portions of said front and back panels may be placed in contact with one another and including locking elements to secure said distal portions together whereby said front panel forms a cantilever support for said shelf panel; and (c) fasteners operative to secure said mounting panels respectively to said upright walls so that said shelf panel is supported in a mounted state on said upright walls as a shelf-like ledge.

24. A foot support device according to claim 23 wherein said locking elements include locking slots in one of said front and back panels and mating tabs in another of said front and back panels.

25. A foot support device according to claim 23 wherein said mounting panels are hingedly secured to lateral side edges of said back panel.

* * * * *